US008872369B2

(12) United States Patent
Bradfield

(10) Patent No.: US 8,872,369 B2
(45) Date of Patent: Oct. 28, 2014

(54) STARTER MACHINE SYSTEM AND METHOD

(75) Inventor: Michael D. Bradfield, Anderson, IN (US)

(73) Assignee: Remy Technologies, LLC, Pendleton, IN (US)

( * ) Notice: Subject to any disclaimer, the term of this patent is extended or adjusted under 35 U.S.C. 154(b) by 192 days.

(21) Appl. No.: 13/404,227

(22) Filed: Feb. 24, 2012

(65) Prior Publication Data

US 2013/0221683 A1 Aug. 29, 2013

(51) Int. Cl.
*F02N 11/00* (2006.01)

(52) U.S. Cl.
USPC ..... 290/38 R

(58) Field of Classification Search
USPC ..... 439/38 R; 29/596; 310/68 E, 68 D
See application file for complete search history.

(56) References Cited

U.S. PATENT DOCUMENTS 4,565,219 A * 1/1986 Kunogi ..... 137/625.65
5,622,148 A 4/1997 Xue et al.
6,011,377 A 1/2000 Heglund et al.
6,104,157 A 8/2000 Kramer et al.
6,323,562 B1 11/2001 Renner et al.
6,608,394 B2 8/2003 Osada et al.
6,634,332 B2 10/2003 Saito et al.
6,651,603 B2 11/2003 Osada et al.
6,653,807 B2 11/2003 Saito et al.
6,702,718 B2 3/2004 Tani
6,754,579 B2 6/2004 Kamiya et al.
6,817,329 B2 11/2004 Buglione et al.
6,822,544 B2 11/2004 Shiga et al.
7,009,475 B2 3/2006 Niimi et al.
7,027,911 B2 4/2006 Nishikawa et al.
7,066,128 B2 6/2006 Satake et al.
7,177,755 B2 2/2007 Nishikawa et al.
7,218,010 B2 5/2007 Albertson et al.
7,219,007 B2 5/2007 Schuster et al.
7,269,499 B2 9/2007 Murakami
7,275,509 B2 10/2007 Kassner
7,281,510 B2 10/2007 Kondo
7,287,500 B2 10/2007 Izumi et al.

(Continued)

FOREIGN PATENT DOCUMENTS

JP 2002070699 3/2002

OTHER PUBLICATIONS

WIPO Search Report and Written Opinion dated Oct. 29, 2012 for corresponding Application No. PCT/US2012/032801; 7 sheets.

*Primary Examiner* — Jean F Duverne
(74) *Attorney, Agent, or Firm* — Greenberg Traurig, LLP

(57) ABSTRACT

Embodiments of the invention provide a starter machine control system including an electronic control unit. The control system can include a starter machine that is in communication with the electronic control unit. The starter machine can comprise a solenoid assembly that includes a plurality of biasing members and a first and a second coil winding. The starter machine can also include a motor that is coupled to a pinion. The starter machine can comprise an electromagnetic switch that is coupled to the first coil winding and is configured to regulate a priming current passing through the first coil winding. In some embodiments, the motor can be electrically coupled to the first winding and the control unit can be capable of closing the electromagnetic switch to circulate the priming current from a power source to the motor through the first coil winding.

7 Claims, 9 Drawing Sheets

(56) References Cited

U.S. PATENT DOCUMENTS

| | | | | |
|---|---|---|---|---|
| 7,458,353 | B2 | 12/2008 | Takahashi | |
| 7,535,328 | B2 | 5/2009 | Kurasawa | |
| 7,628,138 | B2 | 12/2009 | Ando | |
| 7,701,104 | B2 | 4/2010 | Akemakou | |
| 7,733,201 | B2 | 6/2010 | Yoneshima | |
| 7,760,056 | B2 | 7/2010 | Utsunomiya et al. | |
| 7,797,099 | B2 | 9/2010 | Terada | |
| 7,848,875 | B2 | 12/2010 | Nakai | |
| 7,861,683 | B2 | 1/2011 | Saitoh | |
| 7,934,436 | B2 | 5/2011 | Laubender | |
| 7,949,461 | B2 | 5/2011 | Takahashi | |
| 7,982,565 | B2 | 7/2011 | Bradfield | |
| 8,036,815 | B2 | 10/2011 | Okumoto et al. | |
| 8,069,832 | B2 | 12/2011 | Okumoto et al. | |
| 2003/0090348 | A1* | 5/2003 | Simms | 335/6 |
| 2003/0150417 | A1 | 8/2003 | Miwa | |
| 2003/0209373 | A1 | 11/2003 | Egami et al. | |
| 2004/0168664 | A1 | 9/2004 | Senda et al. | |
| 2006/0058897 | A1 | 3/2006 | Senda et al. | |
| 2006/0117876 | A1 | 6/2006 | Lepres et al. | |
| 2006/0201266 | A1 | 9/2006 | Kajino et al. | |
| 2007/0199533 | A1 | 8/2007 | Takahashi | |
| 2009/0020091 | A1 | 1/2009 | Botzenhard et al. | |
| 2009/0183595 | A1 | 7/2009 | Niimi | |
| 2009/0224557 | A1 | 9/2009 | Reynolds et al. | |
| 2009/0295399 | A1 | 12/2009 | Ueda et al. | |
| 2010/0000487 | A1 | 1/2010 | Hoshino et al. | |
| 2010/0033066 | A1 | 2/2010 | Murata et al. | |
| 2010/0036591 | A1 | 2/2010 | Nakai | |
| 2010/0059007 | A1 | 3/2010 | Senda et al. | |
| 2010/0059352 | A1* | 3/2010 | Webb et al. | 200/402 |
| 2010/0083926 | A1 | 4/2010 | Okumoto et al. | |
| 2010/0090526 | A1 | 4/2010 | Itou | |
| 2010/0180849 | A1 | 7/2010 | Senda et al. | |
| 2010/0184562 | A1 | 7/2010 | Senda et al. | |
| 2010/0217484 | A1 | 8/2010 | Mizuno | |
| 2010/0217493 | A1 | 8/2010 | Tomura et al. | |
| 2010/0222973 | A1 | 9/2010 | Senda et al. | |
| 2010/0229815 | A1 | 9/2010 | Senda et al. | |
| 2010/0242905 | A1 | 9/2010 | Machida et al. | |
| 2010/0251851 | A1 | 10/2010 | Usami | |
| 2010/0251852 | A1 | 10/2010 | Murata et al. | |
| 2010/0251853 | A1 | 10/2010 | Usami et al. | |
| 2010/0256896 | A1 | 10/2010 | Kitano et al. | |
| 2010/0257975 | A1 | 10/2010 | Niimi et al. | |
| 2010/0264670 | A1 | 10/2010 | Usami et al. | |
| 2010/0264764 | A1 | 10/2010 | Usami et al. | |
| 2010/0264765 | A1 | 10/2010 | Haruno et al. | |
| 2010/0269630 | A1 | 10/2010 | Niimi et al. | |
| 2010/0269631 | A1 | 10/2010 | Niimi et al. | |
| 2010/0269776 | A1 | 10/2010 | Mizuno | |
| 2010/0282199 | A1 | 11/2010 | Heyers et al. | |
| 2010/0282200 | A1 | 11/2010 | Notani | |
| 2011/0001589 | A1 | 1/2011 | Usami et al. | |
| 2011/0005486 | A1 | 1/2011 | Nakamura | |
| 2011/0056450 | A1 | 3/2011 | Notani | |
| 2011/0084786 | A1 | 4/2011 | Niimi et al. | |
| 2011/0095852 | A1 | 4/2011 | Niimi et al. | |
| 2011/0112740 | A1 | 5/2011 | Hashimoto | |
| 2011/0115238 | A1 | 5/2011 | Biessenberger et al. | |
| 2011/0118962 | A1 | 5/2011 | Couetoux et al. | |
| 2011/0132308 | A1 | 6/2011 | Liu et al. | |
| 2011/0137544 | A1 | 6/2011 | Kawazu et al. | |
| 2011/0139108 | A1 | 6/2011 | Hashim | |
| 2011/0146609 | A1 | 6/2011 | Enoki | |
| 2011/0174255 | A1 | 7/2011 | Neuburger et al. | |
| 2011/0184626 | A1 | 7/2011 | Mauritz et al. | |
| 2011/0248803 | A1 | 10/2011 | Niimi et al. | |
| 2012/0035837 | A1 | 2/2012 | Okumoto et al. | |
| 2012/0256523 | A1* | 10/2012 | Fulton | 310/68 D |
| 2012/0256524 | A1* | 10/2012 | Fulton | 310/68 E |

* cited by examiner

STARTER MACHINE SYSTEM AND METHOD

BACKGROUND

Some electric machines can play important roles in vehicle operation. For example, some vehicles can include a starter machine, which can, upon a user closing an ignition switch, lead to cranking of engine components of the vehicle. Some starter machines can include a field assembly that can produce a magnetic field to rotate some starter machine components.

SUMMARY

Some embodiments of the invention provide a starter machine control system including an electronic control unit. In some embodiments, the control system can include a starter machine that can be in communication with the electronic control unit. In some embodiments, the starter machine can include a solenoid assembly that can include a plurality of biasing members and a motor can be operatively coupled to a pinion. In some embodiments, the starter machine can comprise an electromagnetic switch that can be coupled to the first coil winding and can be configured to regulate a priming current passing through the first coil winding. In some embodiments, the motor can be electrically coupled to the first winding and the control unit can be capable of closing the electromagnetic switch to circulate the priming current from a power source to the motor through the first coil winding.

DETAILED DESCRIPTION

Figure 1:
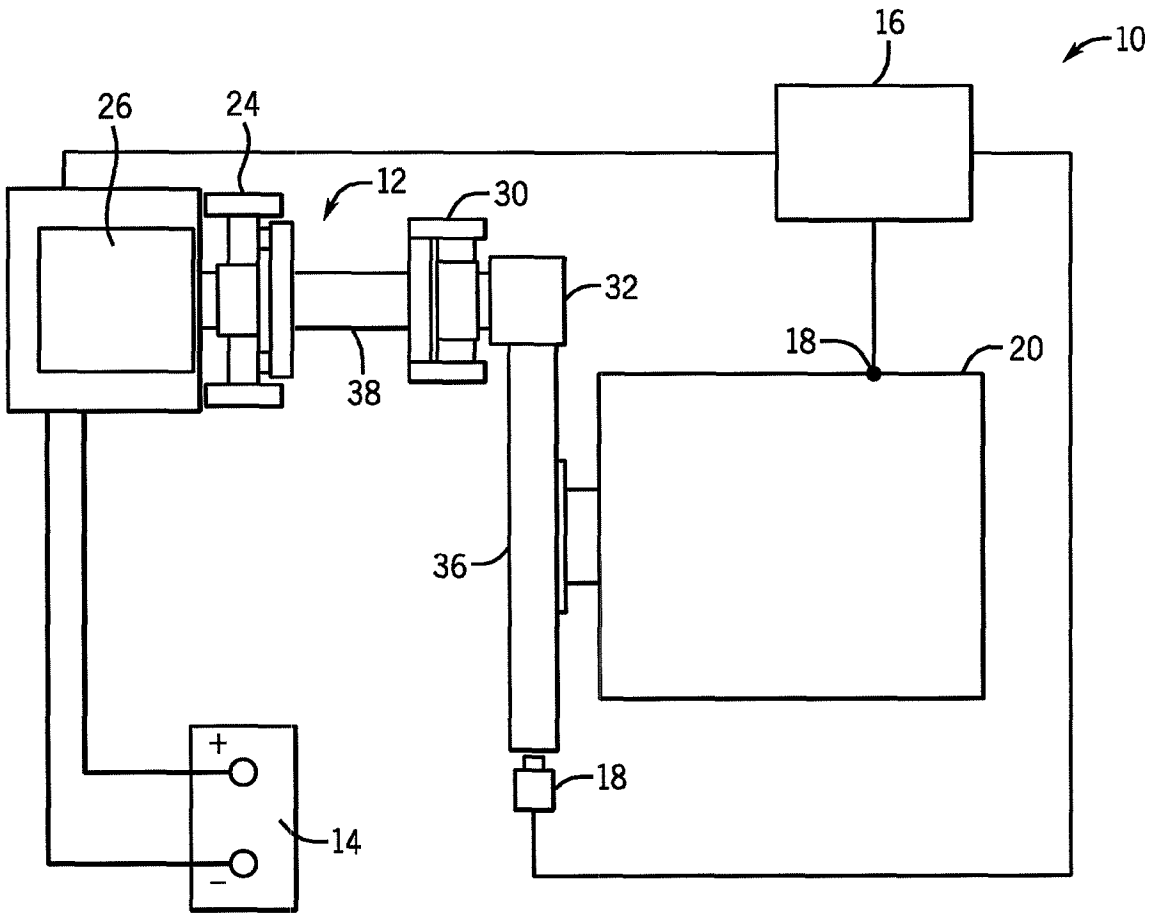
FIG. 1 is a diagram of a machine control system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives that fall within the scope of embodiments of the invention.

FIG. 1 illustrates a starter machine control system 10 according to one embodiment of the invention. The system 10 can include an electric machine 12, a power source 14, such as a battery, an electronic control unit 16, one or more sensors 18, and an engine 20, such as an internal combustion engine. In some embodiments, a vehicle, such as an automobile, can comprise the system 10, although other vehicles can include the system 10. In some embodiments, non-mobile apparatuses, such as stationary engines, can comprise the system 10.

The electric machine 12 can be, without limitation, an electric motor, such as a hybrid electric motor, an electric generator, a starter machine, or a vehicle alternator. In one embodiment, the electric machine can be a High Voltage Hairpin (HVH) electric motor or an interior permanent magnet electric motor for hybrid vehicle applications.

Figure 2A:
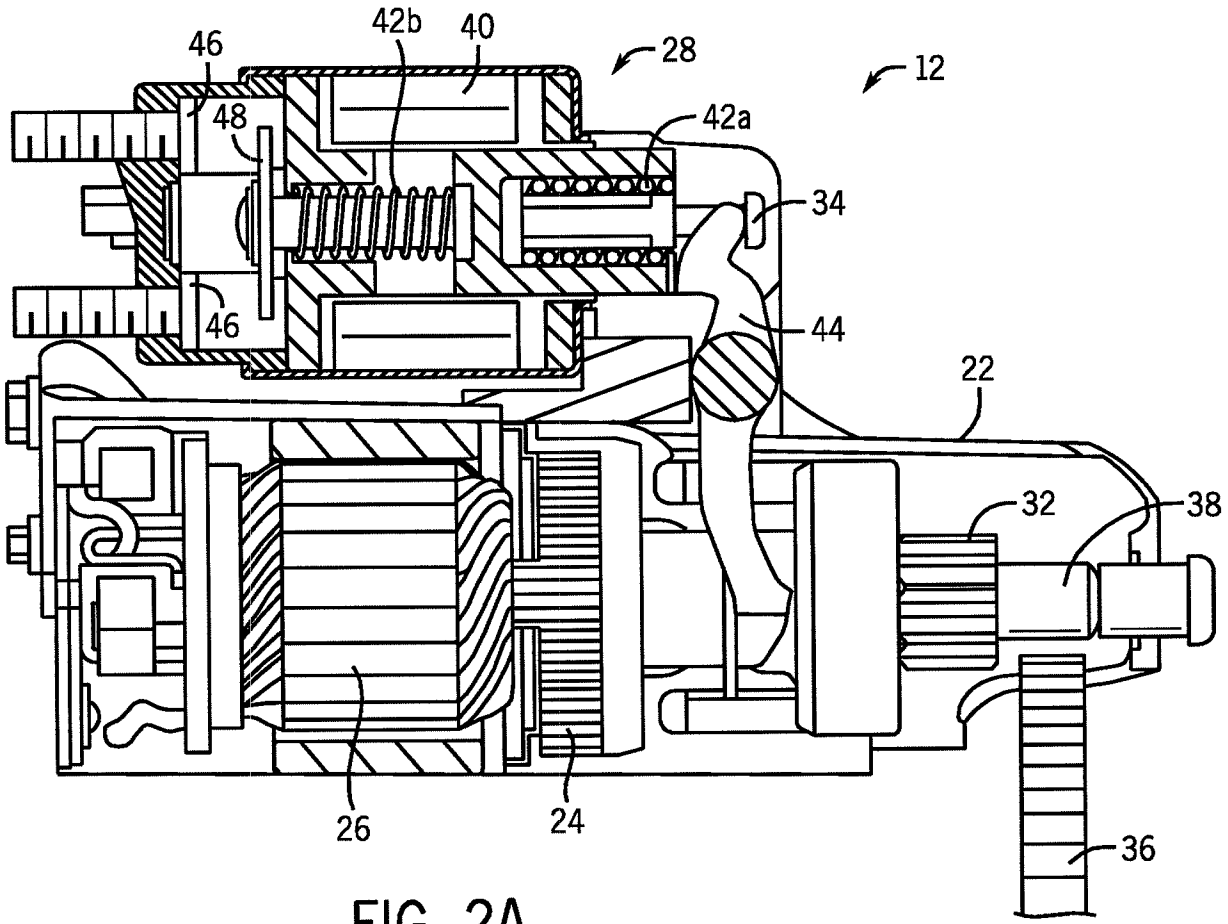
FIGS. 2A and 2B are cross-sectional views of starter machines according to some embodiments of the invention.
Figure 2B:
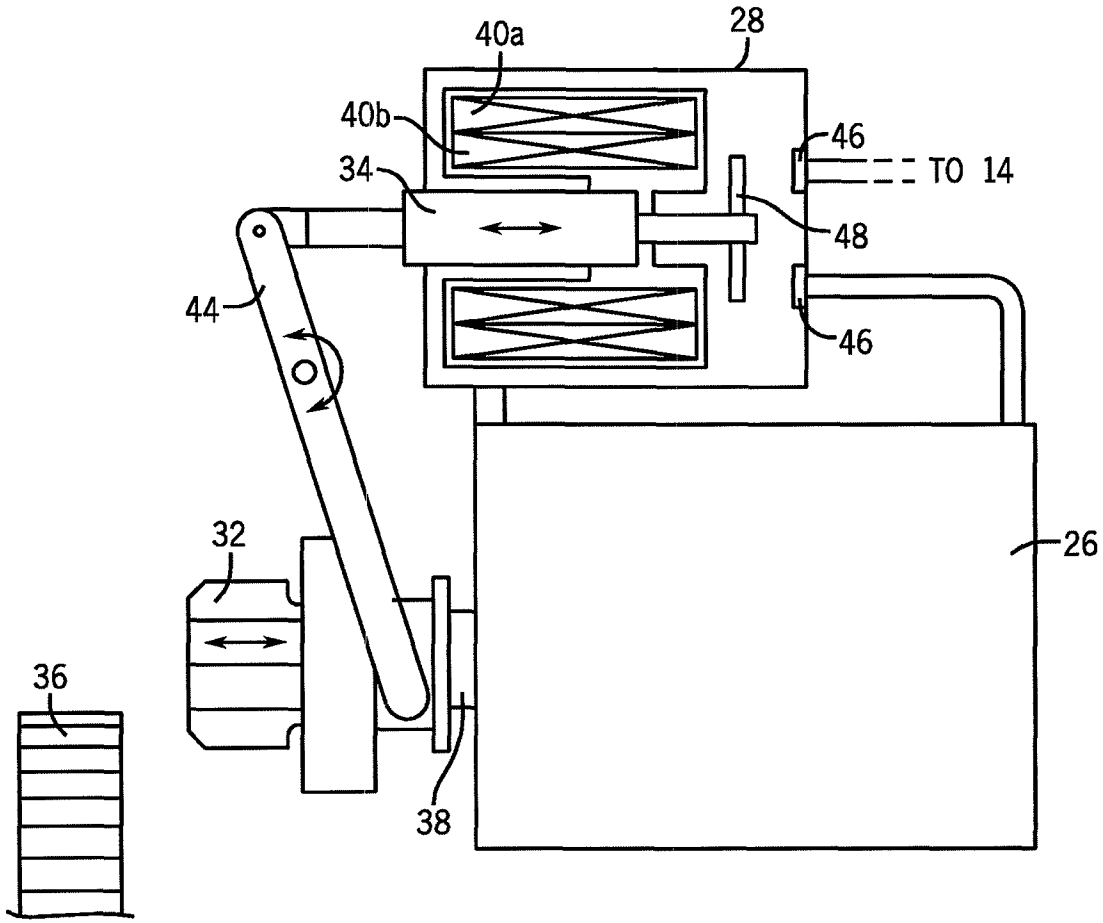

As shown in FIGS. 2A and 2B, in some embodiments, the electric machine 12 can comprise a starter machine 12. In some embodiments, the starter machine 12 can comprise a housing 22, a gear train 24, a brushed or brushless motor 26, a solenoid assembly 28, a clutch 30 (e.g., an overrunning clutch), and a pinion 32. In some embodiments, the starter machine 12 can operate in a generally conventional manner. For example, in response to a signal (e.g., a user closing a switch, such as an ignition switch), the solenoid assembly 28 can cause a first plunger 34 to move the pinion 32 into an engagement position with a ring gear 36 of a crankshaft of the engine 20. Further, the signal can lead to the motor 26 generating an electromotive force, which can be translated through the gear train 24 to the pinion 32 engaged with the ring gear 36. As a result, in some embodiments, the pinion 32 can move the ring gear 36, which can crank the engine 20, leading to engine 20 ignition. Further, in some embodiments, the clutch 30 can aid in reducing a risk of damage to the starter machine 12 and the motor 26 by disengaging the pinion 32 from a shaft 38 connecting the pinion 32 and the motor 26 (e.g., allowing the pinion 32 to free spin if it is still engaged with the ring gear 36).

In some embodiments, the starter machine 12 can comprise multiple configurations. For example, in some embodiments, the solenoid assembly 28 can comprise one or more configurations. In some embodiments, the solenoid assembly 28 can comprise the first plunger 34, a coil winding 40, and a plurality of biasing members 42 (e.g., springs or other structures capable of biasing portions of the solenoid assembly 28). In some embodiments, a first end of a shift lever 44 can be coupled to the first plunger 34 and a second end of the shift lever 44 can be coupled to the pinion 32 and/or a shaft 38 that can operatively couple together the motor 26 and the pinion 32. As a result, in some embodiments, at least a portion of the movement created by the solenoid assembly 28 can be transferred to the pinion 32 via the shift lever 44 to engage the pinion 32 with the ring gear 36, as previously mentioned.

Figure 3A:
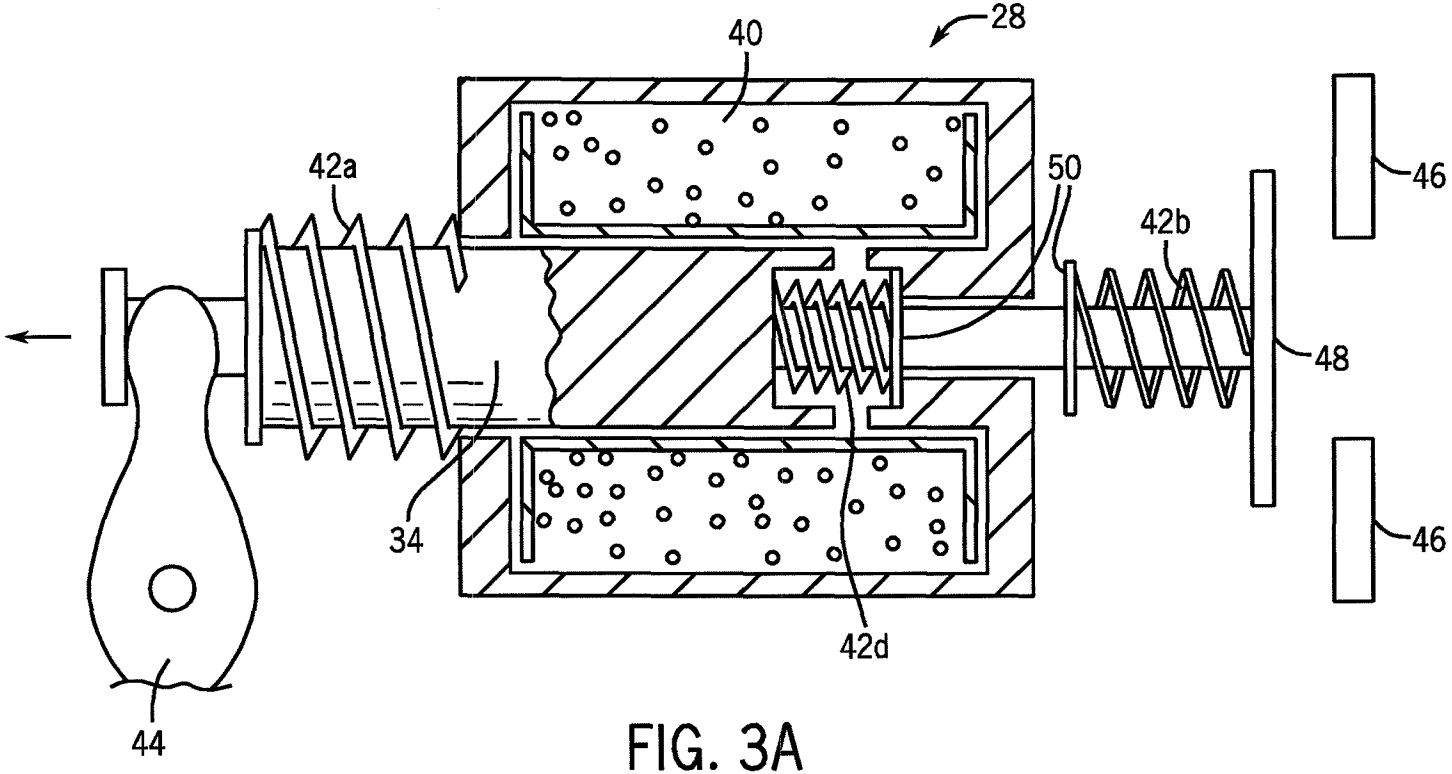
FIGS. 3A and 3B are cross-sectional views of solenoid assemblies according to some embodiments of the invention.
Figure 3B:
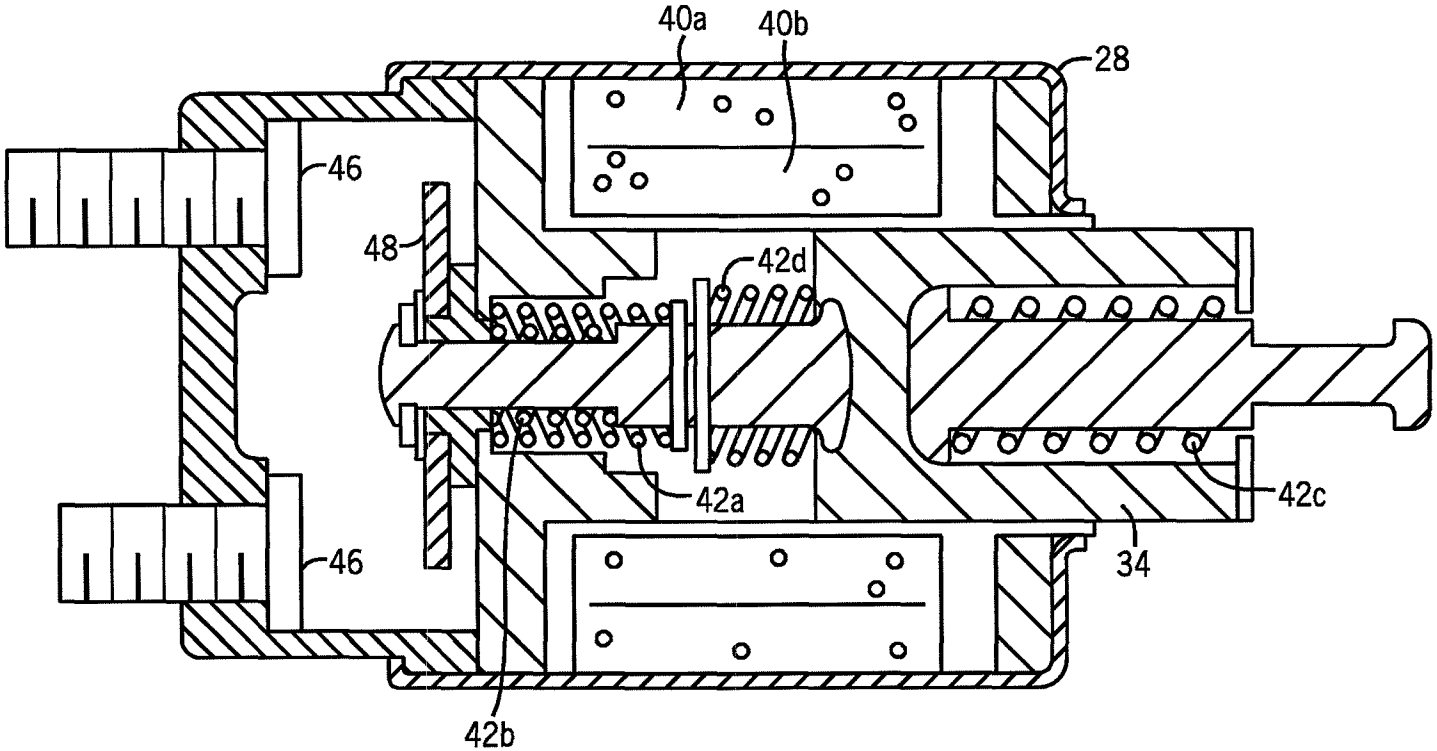

Moreover, as shown in FIGS. 3A and 3B, the solenoid assembly 28 can comprise at least a plunger-return biasing member 42*a* and a contact over-travel biasing member 42*b*. When the starter machine 12 is activated (e.g., by the user closing the ignition switch), the system 10 can energize the coil winding 40, which can cause movement of the first plunger 34 (e.g., in a generally axial direction). For example, current flowing through the coil winding 40 can draw-in or otherwise move the first plunger 34, and this movement can be translated to engagement of the pinion 32, via the shift lever 44 (i.e., the magnetic field created by current flowing through coil winding 40 can cause the first plunger 34 to move). Moreover, the first plunger 34 moving inward as a result of the energized coil winding 40 can at least partially compress the plunger-return biasing member 42*a*.

Figure 4:
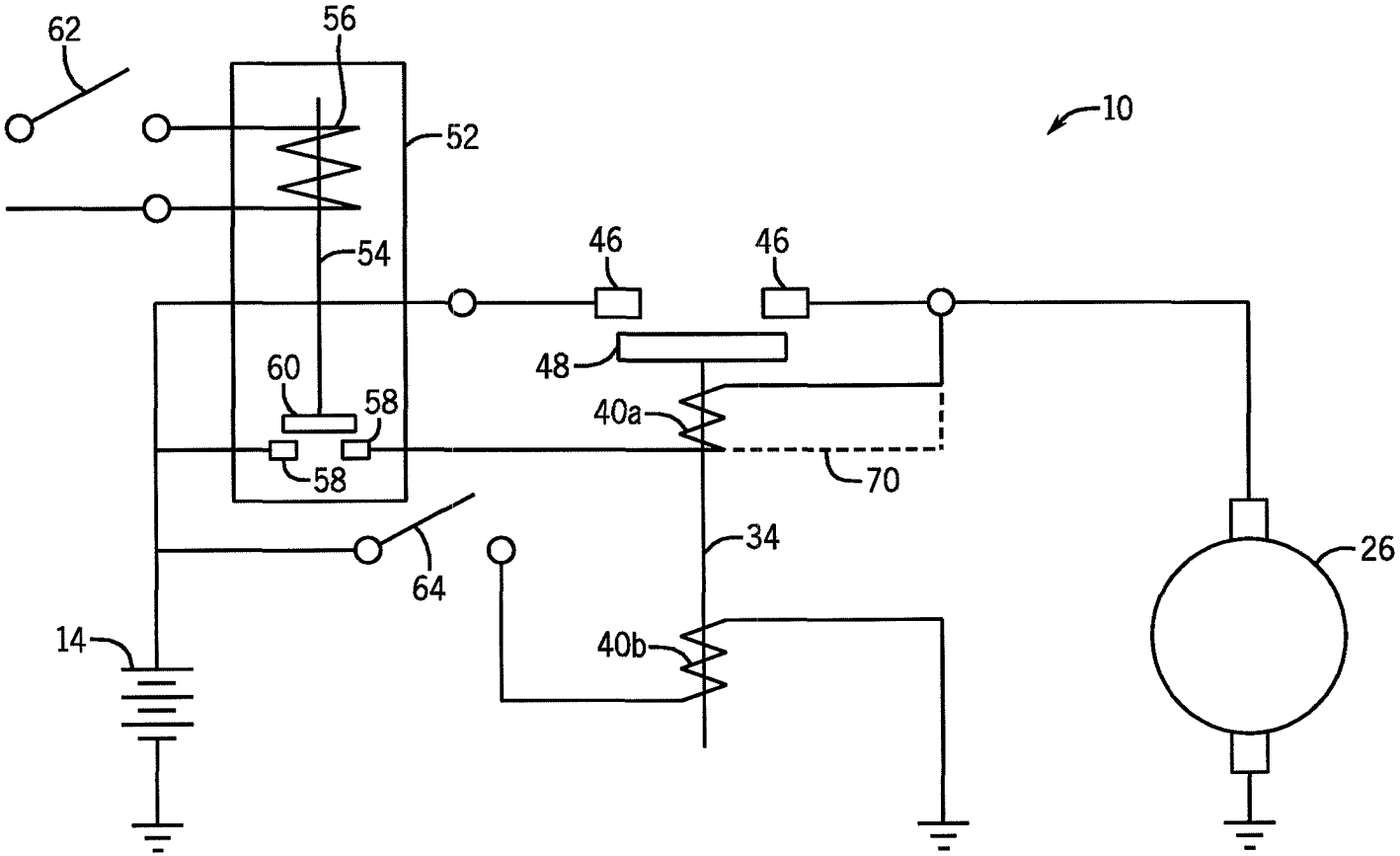
FIG. 4 is a circuit diagram of a starter machine control system according to one embodiment of the invention.

Additionally, in some embodiments, the first plunger 34 can be drawn-in or otherwise moved to a position (e.g., an axially inward position) so that at least a portion of the first plunger 34 (e.g., a lateral end of the first plunger 34) can at least partially engage or otherwise contact one or more first contacts 46 to close a circuit that provides current to the motor 26 from the power source 14, as shown in FIG. 4. As a result, the motor 26 can be activated by the current flowing through the circuit closed by the first plunger 34. For example, in some embodiments, the first plunger 34 can comprise a first plunger contact 48 that can engage the first contacts 46 to close the circuit to enable current to flow to the motor 26. In some embodiments, the contact over-travel biasing member 42*b* can be coupled to and/or disposed over at least a portion of the first plunger 34 at a position substantially adjacent to the first plunger contact 48, as shown in FIG. 3. In some embodiments, the contact over-travel biasing member 42*b* can function to assist the plunger-return biasing member 42*a* in returning the first plunger 34 to the home position. Additionally, in some embodiments, the contact over-travel biasing member 42*b* can also function to assist in separating the first plunger contact 48 and the first contacts 46 (e.g., the biasing force of the compressed contact over-travel biasing member 42*b* can aid in moving the first plunger contact 48 away from the first contacts 46).

In some embodiments, after partial or total completion of the starting event (e.g., the engine has at least partially turned over and combustion has begun), the coil winding 40 can be at least partially de-energized. In some embodiments, the reduction or removal of force retaining the first plunger 34 in place (e.g., the magnetic field created by current flowing through the coil winding 40) can enable the compressed plunger-return biasing member 42*a* to expand. As a result, the plunger-return biasing member 42*a* can expand and return the first plunger 34 to its original position before the initial energization of the coil winding 40 (i.e., a "home" position). Accordingly, the pinion 32 can be withdrawn from the ring gear 36 and return to its original position within the housing 22. Additionally, as shown in FIG. 3B, in some embodiments, the solenoid assembly 28 can also comprise, a drive-return biasing member 42*c* that can be configured and arranged to further aid in returning the first plunger 34 to the home position.

In some embodiments, the starter machine 12 can comprise one or more additional biasing members 42. For example, as shown in FIGS. 3A and 3B, in some embodiments, the starter machine 12 can include at least one auxiliary biasing member 42*d*. In some embodiments, the auxillary biasing member 42*d* can at least partially enable segregation and/or separation of some operations of the starter machine 12 into two or more steps. In some embodiments, the auxiliary biasing member 42*d* can create a stopping point along the axial path of the first plunger 34. For example, as shown in FIGS. 3A and 3B, in some embodiments, the auxiliary biasing member 42*d* can be disposed immediately adjacent to one or more washers 50 or other structures that can function as artificial stops when the first plunger 34 moves during activation of the solenoid assembly 28. By way of example only, the auxiliary biasing member 42*d* and washers 50 can be coupled to a portion of the solenoid assembly 28 and configured and arranged so that as the first plunger 34 moves during solenoid assembly 28 activation, the resistive force of the auxiliary biasing member 42*d* engaging one or more of the washers 50 can require additional force to be overcome to engage the first plunger contact 48 and the first contacts 46 (e.g., creating an artificial stopping point prior to the first plunger contact 48 engaging the first contacts 46).

As shown in FIGS. 2B, 3B, and 4, in some embodiments, the solenoid assembly 28 can comprise more than one coil winding 40. For example, as shown in FIGS. 2B, 3B, and 4, the solenoid assembly 28 can comprise two coil windings 40. In other embodiments, the solenoid assembly 28 can comprise more than two coil windings 40 (not shown). In some embodiments, a first coil winding 40*a* can be configured and arranged to move the first plunger 34 from the home position (i.e., a position occupied by the first plunger 34 when little to no current flows through any of the coil windings 40) to the artificial stopping point. For example, current flowing through the first coil winding 40*a* can create a magnetic field sufficient to move the first plunger 34 from the home position to the artificial stop, but the magnetic field can be of a magnitude that is insufficient to overcome the resistive force of the auxiliary biasing member 42*d*. As a result, activation of the first coil winding 40*a* can move the first plunger 34 to the artificial stop, but in some embodiments, the first plunger contact 48 will not engage the first contacts 46 to close the circuit to provide current to the motor 26.

In some embodiments, the coil winding 40 can comprise a second coil winding 40*b*. The second coil winding 40*b* can be configured and arranged to move the first plunger 34 from the artificial stop to a position where the plunger contacts 48 can engage the first contacts 46 to close the circuit and provide current from the power source 14 to the motor 26. For example, current flowing through the second coil winding 40*b* can create a magnetic field sufficient to move the first plunger 34 from the artificial stop to a position where the first plunger contact 48 can engage the first contacts 46. In some embodiments, the first coil winding 40*a* can be deactivated before and/or after activation of the second coil winding 40*b*. Additionally, in some embodiments, the second or the first coil winding 40*a*, 40*b* can comprise a magnetic field of sufficient magnitude to overcome the resistive force of the auxiliary biasing member 42*d* so that only one coil winding 40 needs to be used. Moreover, in some embodiments, the solenoid assembly 28 can function without the auxiliary biasing member 42*d* so that either the first coil winding 42*a* or the second coil winding 42*b* would be needed to engage the first plunger contact 48 and the first contacts 46 to close the circuit. As shown in FIGS. 2B and 3B, in some embodiments, the coil windings 40*a*, 40*b* can be at least partially co-radially arranged so that one of the coil windings 40 (e.g. the first coil winding 40*a*) can at least partially circumscribed the other coil winding 40 (e.g., the second coil winding 40*b*).

In some embodiments, the coil windings 40*a*, 40*b* can comprise other configurations. In some embodiments, the coil windings 40*a*, 40*b* can function as conventional coil windings 40*a*, 40*b*. Regardless of the number and/or configuration of biasing members 42, the first coil winding 40*a* can be configured and arranged to function as a "pull-in" coil winding 42 and the second coil winding 40*b* can be configured and arranged to function as a "hold-in" coil winding 42, or vice versa. For example, the first coil winding 42*a* can be initially activated by the electronic control unit 16 to initially move the first plunger 34 from the home position. In some embodiments, the solenoid assembly 28 can operate without the auxiliary biasing member 42*d*, and as a result, the first coil winding 40*a* can move the plunger 36 until the first contacts 46, 48 engage to close the circuit (i.e., the first coil windings 40*a* can function to initially "pull-in" the first plunger 34) and to move the pinion 32 into engagement with the ring gear 36. In some embodiments, the second coil winding 40*b* can be activated upon the first contacts 46, 48 engaging or another signal resulting from the first plunger 34 moving. Upon activation, the second coil winding 40*b* can function to retain or "hold-in" the plunger 36 during a starting episode. Moreover, during activation of the second coil winding 40*b*, the solenoid assembly 28 can be configured and arranged so that the first coil winding 40*a* is substantially or completely deactivated by the activation of the second coil winding 40*b*. For example, the second coil winding 40*b* can comprise a greater resistance and, as a result, a lesser current relative to the first set of coil windings 40*a*. Accordingly, the second coil winding 40*b* can operate at a lower temperature relative to the first coil windings 40*a*, and, as a result, can operate for longer periods of time because of the lesser thermal output by the winding 40*b*. In some embodiments, after the engine 20 has been started, the second coil winding 40*b* an be substantially or completely deactivated and the plunger-return biasing member 42*a* can move the first plunger 34 back to the home position.

In some embodiments, the first plunger 34, auxiliary biasing member 42*d*, the washers 50, the coil windings 40*a*, 40*b*, and/or other portions of the solenoid assembly 28 can be configured and arranged so that when the first plunger 34 reaches the artificial stop, the pinion 34 can be positioned substantially adjacent to the ring gear 36. For example, current can flow through the first coil winding 40*a* so that the first plunger 34 is moved (e.g., in a generally inward direction toward the first contacts 46) and the pinion 32 moves (e.g., axially moves) closer to the ring gear 36, via the shift lever 44. As previously mentioned, the auxiliary biasing member 42*d* can at least partially slow down or stop movement of the first plunger 34 before the first plunger contact 48 engages the contacts 36 (i.e., the first plunger 34 can stop at the artificial stopping point). As a result, by circulating current only through the first coil winding 40*a*, the first plunger 34 will move to the artificial stop, but will nearly or completely stop at the artificial stop. Because the first plunger 34 is coupled to the pinion 32 and the shaft 38 via the shift lever 44, this movement of the first plunger 34 from the home position to the artificial stop can move the pinion 32 to a point substantially adjacent to the ring gear 36, but not yet contacting the ring gear 36. As previously mentioned, the system 10 can receive a signal to move forward with the starting episode and current can flow through the second coil winding 40*b* to overcome the biasing forces of the auxiliary biasing member 42*d*. Energizing the second coil winding 40*b* (e.g., in addition to or in lieu of the first coil winding 40*a*) can overcome the biasing forces of the auxiliary biasing member 42*d* so that the first plunger 34 can engage the first contacts 46, the pinion 32 can engage the ring gear 36, and current can flow to the motor 26 to enable the starter machine 12 to start the engine 20.

Figure 5:
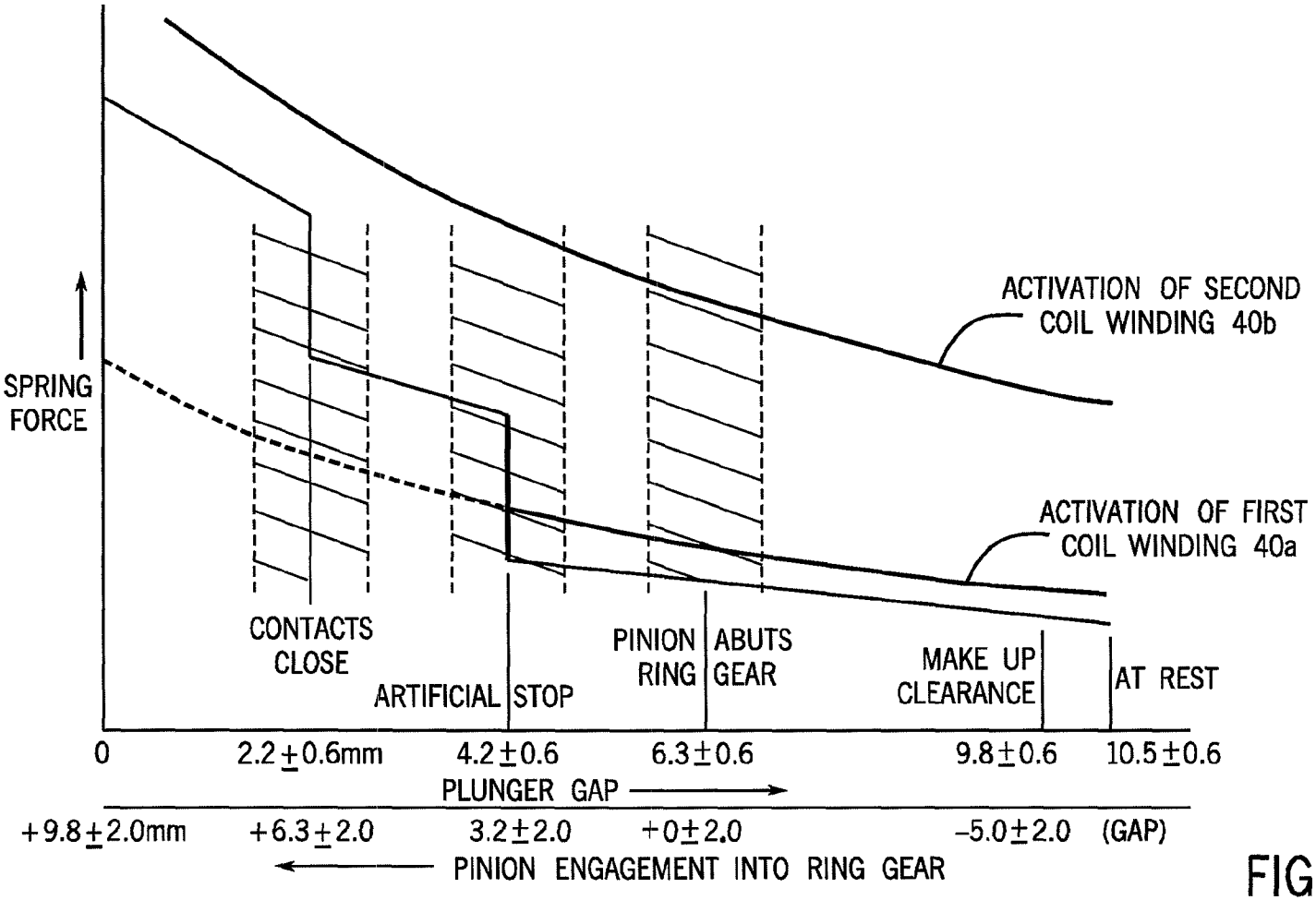
FIG. 5 is a graph illustrating biasing member force required to cause a plunger to move.

The graph illustrated in FIG. 5 illustrates an exemplary embodiment employing the auxiliary biasing member 42*d* in combination with the first and second coil windings 40. As shown in FIG. 5, the force produced by energizing the first coil winding 40*a* is enough to at least partially compress the auxiliary biasing member 42*d* and move the first plunger 34 to the artificial stopping point, but is insufficient to overcome the biasing force of the auxiliary biasing member 42*d*. Moreover, in some embodiments, activating the second coil winding 40*b* can result in a force sufficient enough to overcome the biasing force produced by the auxiliary biasing member 42*d* and enable the first plunger contact 48 to engage the first contacts 46. As a result, a plunger gap size (i.e., the size of a gap between a first plunger 34 outer perimeter and an inner perimeter of a support for the coil windings 40) can decrease over time as the coil windings 40*a*, 40*b* are energize. Moreover, the pinion 32 can become further engaged with the ring gear 36 as the coil windings 40*a*, 40*b* are energized.

In some embodiments, the coil windings 40*a*, 40*b* can be coupled to and/or in communication with the electronic control unit 16 and the power source 14. For example, as previously mentioned, current can circulate through the coil windings 40*a*, 40*b* to move the first plunger 34, and, as a result, move the pinion 32 toward the ring gear 36. In some embodiments, the current circulating through the coil windings 40*a*, 40*b* can originate from the power source 14 (e.g., the battery). Moreover, in some embodiments, the electronic control unit 16 can control the current flow to one, some, or all of the coil windings 40*a*, 40*b* from the power source 14 so that the first plunger 34 moves upon the electronic control unit 16 transmitting the necessary signals for current to flow to the coil windings 40*a*, 40*b*.

For example, as shown in FIG. 4, in some embodiments, the starter machine 12 can comprise one more electromagnetic switches 52. In some embodiments, the electromagnetic switch 52 can be configured and arranged to regulate current flow to the first coil winding 40*a* from the power source 14. For example, in some embodiments, the electromagnetic switch 52 can comprise a second plunger 54 and a third coil winding 56. Similar to some embodiments of the solenoid assembly 28, current flowing through the third coil winding 56 can cause the second plunger 54 to move (e.g., in a generally axial direction) from a home position to another position to close a set of contacts to enable current flow to some parts of the machine 12. For example, in some embodiments, the starter machine 12 circuit can comprise second contacts 58 that can engage a second plunger contact 60 to close a circuit to enable current flow through the first coil winding 40*a*, as shown in FIG. 4. When second plunger contact 60 engages the second contacts 58, current can flow directly from the power source 14 to the first coil winding 40*a*.

In some embodiments, the electromagnetic switch 52 can comprise a portion of the solenoid assembly 28. For example, in some embodiments, the electromagnetic switch 52 can be substantially or completely integral with the solenoid assembly 28, however, in other embodiments, the electromagnetic switch 52 can be disposed within the starter machine 12 substantially adjacent to the solenoid assembly 28. In yet other embodiments, the electromagnetic switch 52 can be disposed in other portions of the starter machine 12 (e.g., distal relative to the solenoid assembly 28) or the starter machine control system 10 (e.g., the electromagnetic switch 52 can be an element of the system 10 that is separate from the starter machine 12).

In some embodiments, one or more of the sensors 18 can comprise an engine speed sensor 18. For example, the engine speed sensor 18 can detect and transmit data to the electronic control unit 16 that correlates to the speed of the engine 20, the crankshaft, and/or the ring gear 36. In some embodiments, the engine speed sensor 18 can communicate with the electronic control unit 16 via wired and/or wireless communication protocols.

In addition to the conventional engine 20 starting episode (i.e., a "cold start" starting episode) previously mentioned, the starter machine control system 10 can be used in other starting episodes. In some embodiments, the control system 10 can be configured and arranged to enable a "stop-start" starting episode. For example, the control system 10 can start an engine 20 when the engine 20 has already been started (e.g., during a "cold start" starting episode) and the vehicle continues to be in an active state (e.g., operational), but the engine 20 is temporarily inactivated (e.g., the engine 20 has substantially or completely ceased moving).

Moreover, in some embodiments, in addition to, or in lieu of being configured and arranged to enable a stop-start starting episode, the control system 10 can be configured and arranged to enable a "change of mind stop-start" starting episode. The control system 10 can start an engine 20 when the engine 20 has already been started by a cold start starting episode and the vehicle continues to be in an active state and the engine 20 has been deactivated, but continues to move (i.e., the engine 20 is decelerating). For example, after the engine receives a deactivation signal, but before the engine 20 substantially or completely ceases moving, the user can decide to reactivate the engine 20 so that the pinion 32 engages the ring gear 36 as the ring gear 36 is decelerating, but continues to move (e.g., rotate). After engaging the ring gear 36, the motor 26 can restart the engine 20 via the pinion 32 engaged with the ring gear 36. In some embodiments, the control system 10 can be configured for other starting episodes, such as a conventional "soft start" starting episodes (e.g., the motor 26 is at least partially activated during engagement of the pinion 32 and the ring gear 36).

The following discussion is intended as an illustrative example of some of the previously mentioned embodiments employed in a vehicle, such as an automobile, during a starting episode. However, as previously mentioned, the control system 10 can be employed in other structures for engine 20 starting.

As previously mentioned, in some embodiments, the control system 10 can be configured and arranged to start the engine 20 during a change of mind stop-start staring episode. For example, after a user cold starts the engine 20, the engine 20 can be deactivated upon receipt of a signal from the electronic control unit 16 (e.g., the vehicle is not moving and the engine 20 speed is at or below idle speed, the vehicle user instructs the engine 20 to inactivate by depressing a brake pedal for a certain duration, etc.), the engine 20 can be deactivated, but the vehicle can remain active (e.g., at least a portion of the vehicle systems can be operated by the power source 14 or in other manners). At some point after the engine 20 is deactivated, but before the engine 20 ceases moving, the vehicle user can choose to restart the engine 20 by signaling the electronic control unit 16 (e.g., via releasing the brake pedal, depressing the acceleration pedal, etc.). After receiving the signal, the electronic control unit 16 can use at least some portions of the starter machine control system 10 to restart the engine 20. For example, in order to reduce the potential risk of damage to the pinion 32 and/or the ring gear 36, a speed of the pinion 32 can be substantially synchronized with a speed of the ring gear 36 (i.e., a speed of the engine 20) when the starter machine 12 attempts to restart the engine 20.

In some embodiments, after receiving the restart signal, the starter machine control system 10 can begin a process to restart the engine 20. The electronic control unit 16 can enable current to flow from the power source 14 to the first coil winding 40*a*. For example, as shown in FIG. 4, in some embodiments, the starter machine 12 can comprise a first switch 62 and a second switch 64. In some embodiments, the first switch 62 can at least partially regulate current flow through the third coil winding 56 and the second switch 64 can at least partially regulate current flow through the second coil winding 40*b*. For example, upon receiving a signal from the electronic control unit 16 to restart the engine 20, the first switch 62 can close, which can enable current to flow through the third coil winding 56. As a result, the second plunger 54 can move from the home position to a point where the second plunger contact 60 engages the second contacts 58 to enable current to flow (e.g., directly flow) from the power source 14 through the first coil winding 40*a*. In some embodiments, once current begins flowing through the first coil winding 40*a*, the first plunger 34 can move from the home position to the artificial stopping point because of the auxiliary biasing member 42*d* functioning to stop movement of the first plunger 34 at the artificial stopping point. As a result, the pinion 32 can be moved to a point substantially adjacent to the ring gear 36 (e.g., an "abutment" position).

Figure 6:
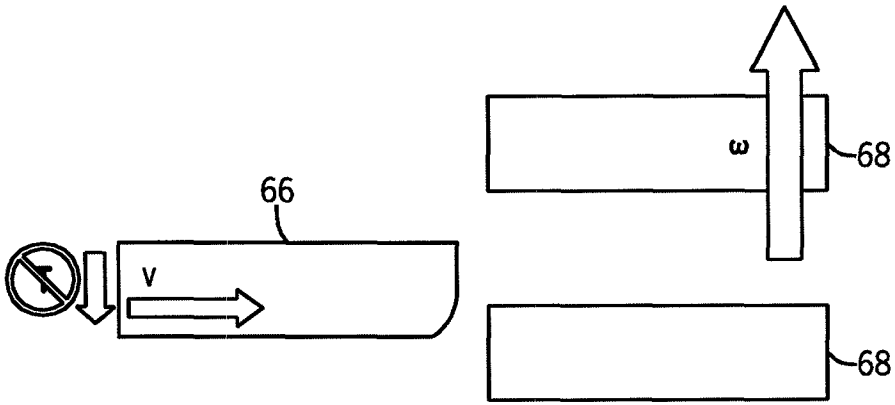
FIG. 6 is an illustration of a pinion and a ring gear according to one embodiment of the invention.

In some embodiments, once the pinion 32 reaches or is substantially adjacent to the abutment position, the motor 26 can become at least partially energized. For example, as shown in FIG. 6, in some embodiments, the pinion 32 can comprise a plurality of pinion teeth 66 and the ring gear 36 can comprise a plurality of ring gear teeth 68. In some embodiments, the pinion teeth 66 and the ring gear teeth 68 can be configured and arranged to engage each other so that the pinion 32 can transmit torque to the ring gear 36 to start the engine 20. In some conventional change of mind stop-start starting episodes (i.e., the ring gear 36 comprises a positive angular velocity, ω), the pinion 32 and motor 26 can comprise a drag torque that opposes the angular velocity of the ring gear 36, as shown in FIG. 6. As a result, in some conventional systems, if the pinion 32 engages the ring gear 36 when the pinion 32 lacks all or substantially all angular velocity, the drag torque of the pinion 32 and the motor 26 can cause frictional sliding and an auditory output when the pinion 32 engages the ring gear 36.

Some embodiments of the invention can be configured to reduce and/or eliminate at least some of the problems associated with the drag torque of the pinion 32 and the motor 26. For example, in some embodiments, a priming current can be circulated to the motor 26 to overcome at least a portion of the drag torque. For example, in some embodiments, the first coil winding 40*a* can be electrically coupled to the motor 26 and the power source 14, as shown in FIG. 4. As previously mentioned, activation of the electromagnetic switch 52 can enable a current to flow through the first coil winding 40*a*, which can create a magnetic field to move the first plunger 34 to the artificial stopping point and, as a result, the shift lever 44 can move the pinion 32 to a position substantially adjacent to the ring gear 36. Moreover, activation of the first coil winding 40*a* can also enable a current to flow to the motor 26 to reduce and/or eliminate at least a portion of the drag torque. In some embodiments, with the drag torque of the motor 26 being substantially or completely offset by the priming current, the pinion 32 can engage the ring 36 when the ring gear 36 is moving at speeds that, for some conventional motors 26 and pinions 32, would produce significant auditory output and frictional sliding, which leads to improved performance and a more pleasant experience for the driver (e.g., because of the reduced auditory output). Moreover, as a result of the priming current offsetting at least a portion of the drag torque, when the pinion 32 is substantially adjacent to the ring gear 36, the pinion 32 can more freely move (e.g., rotate) relative to times when the priming current does not offset some or all of the drag torque.

Figure 7:
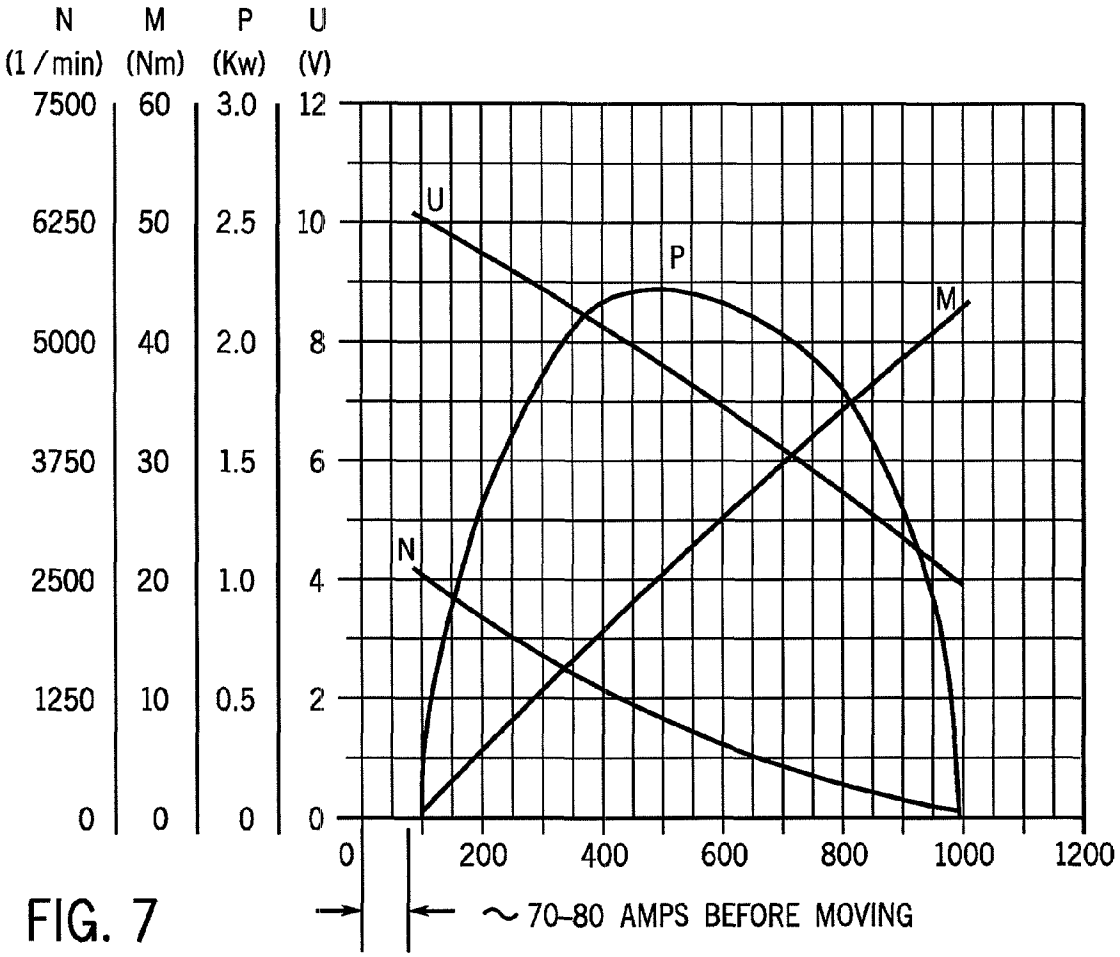
FIG. 7 is a graph representing the relative relationships of current and torque output of a starter machine according to one embodiment of the invention.

As shown in FIGS. 4 and 7, the priming current provided through activation of the first coil winding 40*a* can comprise a magnitude sufficient to offset at least a portion of the drag torque, but insufficient to cause the motor 26 to being moving. As a result, the pinion 32 remains substantially or completely stationary to reduce or prevent the chance of milling when the pinion 32 engages the ring gear 36. As reflected by the graph of FIG. 7, torque produced by the motor 26 (labeled "M" in FIG. 7) is closely correlated (i.e., a linear function) to current supplied to the motor 26. For some motors 26, however, a zero value torque output does not substantially or completely correlate with a zero Amp current input because of the drag torque associated with stationary motor 26. As a result, the motor 26 can receive a certain amount of current to offset at least a portion of the drag torque before the motor 26 begins moving and producing torque. In some embodiments, the priming current provided to the motor 26 by the activation of the first coil winding 40*a* (i.e., originating from the power source 14 before passing through the first coil winding 40*a*) can comprise a magnitude sufficient to overcome at least a portion of the drag torque, but insufficient to drive the motor 26. By way of example only, some motors 26 may require approximately 80 Amps of priming current before the motor 26 begins moving (i.e., before the motor 26 begins producing appreciable torque, as measured in Newton*meters). Other motors 26 can require different values of priming current (e.g., more or less current than 80 Amps) to offset the drag torque, and, accordingly, the starter machine control system 10 can be configured and arranged to provide different amounts of priming current to different motors 26 (e.g., the control system 10 can comprise different configurations for different motors 26).

In some embodiments, the starter machine control system 10 can be configured and arranged to enable a priming current to reach the motor 26 of a current level that will not lead to motor 26 damage. For example, without significant drag torque and/or an applied load on the motor 26 (e.g., moving the pinion 32 and the ring gear 36), the motor 26 can move at sustained high speeds that could potentially damage and/or destroy the motor 26. In some embodiments, portions of the starter machine control system 10 (e.g., at least one of the coil windings 40) can be configured to limit the current through the motor 26 by augmenting a resistance of the current flow path, which can lead to a reduced applied voltage (e.g., voltage applied to the motor 26). For example, the resistance necessary to provide a suitable priming current can be calculated using the known relationships between voltage, current, and resistance.

The following calculation is intended for illustrative purposes only and can be adapted to be useful with other systems with varying voltages, currents, and resistances. By employing the known relationship between voltage, current, and resistance (i.e., voltage equals current multiplied by resistance), the parameters necessary to calculate the resistance needed to provide the desired priming current can be calculated. For example, in some embodiments, the power source 14 can provide 12.6 Volts and can comprise a 0.006 Ohm resistance. Moreover, a cable coupling together the power source 14 and portions of the starter machine 12 can comprise a 0.005 Ohm resistance and the starter machine's 12 overall circuitry can comprise a 0.006 Ohm resistance. In order to calculate the resistance (e.g., a resistance of the first coil winding 40*a*) necessary to provide about 70 Amps of priming current to the motor 26, the voltage equals current multiplied by resistance equation can be solved for the unknown resistance. For example, the following equation can be resolved for the unknown resistance 12.6 Volts=70 Amps×(0.005 Ohms+0.005 Ohms+0.006 Ohms+$R_{unknown}$), which results in a resistance of 0.164 Ohms for the first coil winding 40*a* (i.e., $R_{unknown}$ from the above equation) to produce the desired current.

In some embodiments, if the first coil winding 40*a* cannot provide a priming current of desired magnitude (e.g., too great or too little current), the starter machine 12 can comprise a shunt 70. In some embodiments, the starter machine 12 can comprise the shunt 60 regardless of whether the first coil winding 40*a* can relay a sufficient priming current. As represented in FIG. 4, the shunt 70 can extend from the first coil winding 40*a* to a wire coupled to the motor 26. In some embodiments, the shunt 70 can be configured to comprise the resistance necessary to provide the proper level of current and applied voltage to the motor 26. By way of example only, in some embodiments, the shunt 70 can comprise an additional conventional coil winding 40 (not shown) that can be disposed within the solenoid assembly 28. In some embodiments, in order to produce no net magnetomotive force, the shunt 70 can comprise reversing turns to produce a path of fixed resistance that provides current to the motor 26.

In some embodiments, at any point after initially circulating the priming current to the motor 26, the motor 26 can be substantially or fully energized by the activation of the second coil winding 40*b*. For example, in some embodiments, the electronic control unit 16 can be configured so that after a predetermined amount of time, the second switch 64 can close, the second coil winding 40*b* can be energized, which can move the first plunger 34 to a position where the first plunger contact 48 can engage the first contacts 46 to provide full power to the motor 26. Moreover, as the first plunger 34 moves to engage the first contacts 46, the pinion 32 can be moved to engage the ring gear 36. In some embodiments, the electronic control unit 16 can be configured to energize the second coil winding 40*b* after at any point after the electronic control unit 16 energizes the first coil winding 40*a*. For example, after passing through the first winding coil 40*b*, and the shunt 70 in some embodiments, the priming current can reach the motor 26 to reduce or eliminate the drag torque. As a result, at any point after priming current reaches the motor 26 (e.g., a short time interval or a long time interval), the second switch 54 can pass current through the second coil winding 40*b* to provide full power to the motor 26 to start the engine 20. For example, at any point after the starter machine control system 10 receives a change of mind stop-start restart signal, the electronic control unit 16 can energize the first coil winding 40*a* to move the pinion 32 substantially adjacent to the ring gear 36 and to provide the priming current to the motor 36. In some embodiments, at any point after the priming current reaches the motor 26 (e.g., at any point after receiving the restart signal), up to and including a point where the ring gear 36 substantially or completely ceases moving, the electronic control unit 16 can energize the second coil winding 40*b* to enable completion of the starting episode.

Some conventional starter machine 12 electrical systems can be configured so that, prior to engagement of the first plunger contact 48 and the first contacts 46, the magnitude of current entering the motor 26 can be limited by the capabilities of the first and second switches 62, 64. For example, some switches 62, 64 can be configured so that only a limited amount of current (e.g., 30 Amps) can circulate through the switches. As a result, in some conventional circuits, unless current passes through the circuit closed by the first plunger contact 48 and the first contacts 46, only a limited amount of current can reach the motor 26 (i.e., before the pinion 32 engages the ring gear 36).

Some embodiments of the invention can enable a current comprising a greater magnitude to reach the motor 26 prior to engagement of the pinion 32 and ring gear 36. Although the first switch 62 can be limited in its ability to circulate a current of sufficient magnitude to the motor 26, the current passing through the first switch 62 can be sufficient to generate enough magnetomotive force within the electromagnetic switch 52 (e.g., by passing through the third coil winding 56) to move the second plunger 54 to engage the second contacts 58. Moreover, as previously mentioned, in some embodiments, by engaging the second plunger contact 60 and the second contacts 58, the circuit between the first coil winding 40*a* and the power source 14 can be closed so that current flows from the power source 14 to the motor 26 after passing through the first coil winding 40*a*, and, in some embodiments, the shunt 70.

In some embodiments, the electromagnetic switch 52 can enable the motor 26 to begin moving prior to engagement of the pinion 32 and the ring gear 36 (e.g., without closing the second switch 64). For example, the current limitation imposed by the first switch 62 in a conventional configuration would limit the current to the maximum allowable current of the switch 62 (e.g., 30 Amps), however, in some embodiments of the invention by directly coupling together the motor 26 and the power source 14 through the first coil winding 40*a* (e.g., by engaging the second plunger contact 60 and the second contacts 58), a greater amount of current can pass through the first coil winding 40*a* to the motor 26, which can result in the motor 26 moving to drive the pinion 32 prior to engagement. As a result, the pinion 32 can also have an angular velocity when during pinion 32 to ring gear 36 engagement to reduce auditory output and potential damage to the pinion 32 and/or the ring gear 36.

In some embodiments, the starter machine 12 can be configured and arranged so that a current of a desired magnitude reaches the motor 26 after passing through the first coil winding 40*a*. Similar to some embodiments that were previously mentioned, the circuit of the starter machine 12 can be configured to comprise a resistance necessary to provide the desired current to the motor 26. As previously mentioned, by employing the known relationship between voltage, current, and resistance (i.e., voltage equals current multiplied by resistance), the resistance necessary to produce the desired current value can be calculated. For example, in some embodiments, by circulating a current greater than about 70 or 80 Amps through the motor 26 (e.g., the motor 26 represented in FIG. 7) without any load on the motor 26 (e.g., the pinion 32 is not engaged to the ring gear 36), the motor 26 can begin accelerating toward a free speed (e.g., the maximum speed). Accordingly, the circuitry of starter machine 12 and the circuitry coupling together the power source 14 and the starter machine 12 can be configured to comprise a resistance necessary to deliver a current of the desired magnitude to the motor 26 to begin movement of the pinion 32 (e.g., a current greater than 80 Amps for the motor 26 depicted in FIG. 7). Moreover, as previously mentioned, in some embodiments, the starter machine 12 can comprise one or more shunts 70 to further aid in adjusting the resistance to the desired amperage.

Accordingly, in some embodiments, the starter machine 12 can comprise different capabilities depending on the resistance of at least a portion of the circuitry. For example, in some embodiments, the resistance of the one or more wires disposed between the power source 14 and the motor 26 (e.g., including the first coil winding 40*a*) can comprise a resistance so that a priming current (e.g., a current insufficient to cause the motor 26 to begin moving) reaches the motor 26 to substantially or completely offset the drag torque of the motor 26 and/or the pinion 32. In some embodiments, the resistance of the one or more wires disposed between the power source 14 and the motor 26 (e.g., including the first coil winding 40*a*) can comprise a resistance so that a current (e.g., a current sufficient to cause the motor 26 to begin moving) reaches the motor 26 to begin driving the motor 26 to rotate the pinion 32 prior to engagement of the pinion 32 and the ring gear 36.

In some embodiments, the starter machine 12 can be configured and arranged to enable different current levels to reach the motor 26. By way of example only, in some embodiments, the shunt 70 can comprise a switch (e.g., a MOSFET) (not shown) that can be coupled to and/or in communication with the electronic control unit 16. As a result, if the electronic control unit 16 processes data received from one or more of the sensors 18 that indicates that a priming current should be circulated to the motor 26 (e.g., a current of a lesser magnitude), the switch can close and current can flow through the shunt 70, which can result in a greater resistance path and a lesser current reaching the motor 26. In some embodiments, if the if the electronic control unit 16 processes data received from one or more of the sensors 18 that indicates that the motor 26 should begin moving prior to engagement of the ring gear 36 and the pinion 32, the switch can either remain open or be opened and current can flow directly from the first coil winding 40*a* to the motor 26, which can result in a lesser resistance path and a greater current reaching the motor 26 to begin driving the motor 26.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A starter machine control system comprising:

a starter machine capable of being in communication with an electronic control unit, the starter machine further comprising a solenoid assembly comprising a plunger and plunger contacts, a plunger-return biasing member, a contact over-travel biasing member, an auxiliary biasing member, at least a first coil winding and a second coil winding, an electromagnetic switch being electrically coupled to the first coil winding, the electromagnetic switch being configured and arranged to regulate at least a portion of a priming current passing through the first coil winding;

a first switch electrically coupled to the electromagnetic switch and configured and arranged to activate the electromagnetic switch to enable the priming current to pass from a power source through the first coil winding to a motor operatively coupled to a pinion; and wherein activation of the electromagnetic switch causes the plunger to move to an artificial stopping point comprising the auxiliary biasing member engaging an artificial stop; and a second switch electrically coupled to second coil winding and configured and arranged to enable a current from the power source to flow through the second coil winding; and wherein the activation of the second switch causes the plunger to move from the artificial stopping point to a position where the plunger contacts are substantially coupled with first contacts enabling current to flow to the motor; and wherein the motor is electrically coupled to the first coil winding, and wherein the electronic control unit is capable of closing the electromagnetic switch to circulate the priming current from the power source to the motor through the first coil winding.

2. The starter machine control system of claim 1, wherein the priming current is insufficient to cause the motor to move.

3. The starter machine control system of claim 1, wherein the solenoid assembly comprises one or more washers that are configured and arranged to engage the auxiliary biasing member to form the artificial stop.

4. The starter machine control system of claim 3, and wherein the plunger is at least partially circumscribed by the first coil winding and the second coil winding.

5. The starter machine control module of claim 1, wherein the starter machine comprises at least one shunt disposed between the first coil winding and the motor.

6. The starter machine control system of claim 1, wherein the second coil winding at least partially circumscribes the first coil winding.

7. The starter machine control system of claim 1, wherein the electronic control unit is configured and arranged to circulate the priming current through to the motor in response to the occurrence of a change of mind stop-start starting episode.

* * * * *